United States Patent [19]

Hunt

[11] Patent Number: 4,987,610

[45] Date of Patent: Jan. 29, 1991

[54] SLIDE GARMENT FOR ATHLETIC UNIFORMS

[76] Inventor: William J. Hunt, 2410 Kingsley Dr., Macon, Ga. 31204

[21] Appl. No.: 359,694

[22] Filed: May 31, 1989

[51] Int. Cl.[5] ..... A41B 1/00; A41B 1/18

[52] U.S. Cl. ..... 2/46; 2/51; 2/115; 2/119; 2/DIG. 6

[58] Field of Search ..... 2/2, 22, 23, 46, 70, 2/71, 72, 107, 117, 118, 119, DIG. 6, 51

[56] References Cited

U.S. PATENT DOCUMENTS

| | | | |
|---|---|---|---|
| 380,576 | 4/1888 | Ives | 2/51 |
| 415,837 | 11/1889 | Frisbee | 2/51 |
| 561,851 | 6/1896 | Addinsell | 2/118 |
| 786,924 | 4/1905 | Spurgin | 2/51 |
| 1,128,122 | 2/1915 | Fox | 2/22 |
| 1,478,626 | 12/1923 | Wares | 2/22 |
| 1,612,766 | 12/1926 | Levinson | 2/22 |
| 1,641,318 | 9/1927 | Carey | 2/22 |
| 1,670,935 | 5/1929 | Maynard | 2/22 |
| 1,720,439 | 7/1929 | Richardson | 2/2 |
| 1,740,171 | 12/1929 | Goldsmith | 2/2 |
| 1,753,739 | 4/1930 | Burns | 2/229 |
| 1,771,253 | 7/1930 | Goldstein | 2/229 |
| 1,794,307 | 2/1931 | Lowenbaum, Jr. | 2/72 |
| 1,805,734 | 5/1931 | Jones | 2/2 |
| 1,898,606 | 2/1933 | Whitley | 2/2 |
| 2,179,631 | 11/1939 | Holder | 2/22 |
| 2,249,966 | 7/1941 | Matthews | 2/2 |
| 2,263,538 | 9/1941 | Freirich | 2/51 |
| 2,498,254 | 2/1950 | Davidson | 2/106 |
| 2,516,598 | 7/1950 | Selkirk | 2/2 |
| 2,562,234 | 7/1951 | Gottschalk | 2/117 |
| 4,689,829 | 9/1987 | Kaplan | 2/46 |

*Primary Examiner*—Werner H. Schroeder
*Assistant Examiner*—Jeanette E. Chapman
*Attorney, Agent, or Firm*—Dowell & Dowell

[57] ABSTRACT

A slide garment for use in athletic activities and particularly for use by baseball players in which an apron or a separate material flap is secured to the jersey or shirt of the uniform in an area such that the upper edge of the apron will extend above the belt line or waistband of the pants of the uniform when the jersey is tucked within the pants and wherein the apron extends downwardly over the belt or waistband of the uniform and includes fastening elements for securing the lower portion of the apron to the upper portion of the pants to thereby prevent dirt and debris from entering between the pants and the jersey. In one embodiment, a simulated belt or waistband may be provided across the front surface of the apron.

11 Claims, 1 Drawing Sheet

SLIDE GARMENT FOR ATHLETIC UNIFORMS

BACKGROUND OF THE INVENTION

1. Field of the Invention

This invention is generally directed to articles of clothing and more particularly to a protective garment which may be utilized by ball players so as to prevent dirt and debris from entering between their jersey and pants during activities such as when a baseball player slides into a base. The garment of the present invention may be separately applied to existing uniforms or may be incorporated directly with shirts or jerseys so as to provide a combination shirt and apron which will allow for the aformentioned protection when being worn. In either case, the garment includes an apron-like material which is secured to the front portion of a uniform jersey above the tail or bottom of the jersey so that the tail of the jersey may be tucked within the pants of the uniform in a conventional manner. It is preferred that the entire upper edge of the apron be secured to the jersey so that the upper edge is disposed adjacent to but slightly above the belt line or waistband of the pants. The lower edge of the apron will include fastening elements which are provided along the inner surface of the apron and which may be selectively secured to complimentary fastening elements which are provided along the upper portion of the pants and below the belt or waistband.

In one embodiment of the present invention, a simulated belt or waistband may be provided across the front surface of the apron of the present invention so that the overall appearance of the uniform when utilizing the apron remains similar to the uniform without the apron. The apron preferably extends substantially across the front portion of the jersey so that a player is afforded protection when sliding toward a base either on their stomach or on their side.

In the preferred embodiment, the apron is sewn to the shirt or jersey with the lower edge of the apron being connected by use of interconnecting hook and loop fabric fasteners such as VELCRO TM. In other embodiments, the upper edge of the apron may be selectively and continuously secured by the use of suitable fasteners to the front portion of the jersey. In all embodiments, it is preferred that the apron be formed of the same material from which the uniform is formed and also be similarly colored or decorated so as to form a matching accessory for the uniform.

2. Description of the Related Art

Heretofore there have been many garments or accessories for garments which have been designed for the purpose of giving athletes added protection during actual competition. Many of such accessories or garments have been specifically designed for use by baseball players to protect the players during activities such as sliding into a base. However, most prior art protectors for baseball uniforms have dealt with supplemental pads which may be worn either as an accessory to a uniform or as an extra garment. Such protectors are designed to protect the thighs and buttox of the player as the player slides along the ground in an effort to avoid a tag when approaching a given base. Such garments are disclosed in U.S. Pat. No. 835,219 to Flick, U.S. Pat. No. 967,750 to Fox, U.S. Pat. No. 1,044,494 to Clarke, U.S. Pat. No. 1,088,273 to Golden, U.S. Pat. No. 1,128,122 to Fox, U.S. Pat. No. 1,478,676 to Wares, U.S. Pat. No. 1,612,766 to Levinson, U.S. Pat. No. 1,641,318 to Carey, U.S. Pat. No. 2,179,631 to Holder and U.S. Pat. No. 2,516,598 to Selkirk. Although each of these references discloses a protective pad for protecting a baseball player as the player slides, none of the references have considered either the discomfort or embarrassment that a player may have when they slide into a base head first and thereby cause dirt and other debris to become trapped within the pants or trousers of the uniform. Often, a player will have to ask for or request a time out so that dirt can be shaken from the pants and in some instances, debris or dirt cannot be effectively removed until the player is able to leave the field so that dirt or debris can be removed from the trousers or pants when the player is in an area of privacy.

Other types of protectors which are specifically designed to protect an athlete from the elements and which are designed as accessories for clothing are also known. In U.S. Pat. No. 4,689,829 to Kaplan, a covering device is disclosed which is adapted to be mounted along the back portion of a person's belt so that the covering may be unrolled so as to extend over and protect the pants seat from becoming moist or wet as a skier is seated on a ski lift chair. Unfortunately, this type of protecting garment only protects the surface of the garment itself but does not prevent foreign material from entering between an individual's shirt and trousers.

Another type of clothing protector is disclosed in U.S. Pat. No., 380,576 to Ives. In this reference, the lower portion of an individuals vest and the upper portion of the pants may be protected from various elements by providing a bib which is hooked or secured along the front portion of the vest. The covering extends down across the belt line and over the upper portion of the pants or trousers. However, with this type of protector, as with the protector discussed above with respect to the patent to Kaplan the protector is not designed to prevent foreign material from entering between a baseball player's jersey and pants as the player slides into a base.

Some additional examples of aprons or detachable clothing garments are disclosed in U.S. Pat. Nos. 2,846,685 to Ehrich, 4,266,299 to Beal and 4,698,854 to Slimmon.

SUMMARY OF THE INVENTION

This invention is directed to a protective material flap or apron which is particularly designed for use with baseball uniforms and which includes a flap which is secured or mounted to the lower front portion of the jersey of a player's uniform above and in spaced relationship with respect to the lower edge portion of the jersey so that the flap or apron will extend over the upper waist-band or belt line when the shirt is tucked into or beneath the pants or trousers. The flap or apron is preferably sewn to the jersey of the uniform and is formed of the same material as the jersey, however, in some cases, alternate means of fastening may be incorporated to secure the entire length of the upper edge of the flap or apron to the jersey. The flap or apron is also preferably of a size to extend substantially across the front width of the jersey so that when the apron is suspended over the pants of the uniform, the flap will protect the area between the pants and the jersey to prevent dirt and other debris from entering into the pants as a baseball player slides, head first, into a base when either on their stomach or on their side.

In the preferred embodiment of the invention, the lower portion of the flap or apron includes a hook and loop material fastening element such as VELCRO TM which extends along the inner edge of the flap and which is engageable with compatible hooked material which is secured across portions of the upper area of the pants or trousers of the uniform. The use of hook and loop fabric fasteners such as VELCRO TM or other suitable fasteners such as buttons, snaps or zippers and the like will allow the flap to be maintained in position during normal play. However, it is envisioned that in some circumstances the flap will not need to be secured to the pants and may be allowed to freely hang.

With some uniforms, a conventional belt is still worn which extends through belt loops which are conventionally secured to the upper waist area of the pants or trousers. In order to simulate a complete uniform appearance, the apron or flap of the present invention may have a simulated belt secured or formed along the front portion thereof thereby establishing the normal appearance for the uniform. In some uniforms, an elastic waistband is used as opposed to a belt. In these instances, the front of the flap would include the same physical characteristics and appearance as the waistband of the pants or trousers so that the overall uniform appearance is maintained.

The slide bib or flap of the present invention may be selectively secured to existing jerseys either by use of suitable fasteners or by sewing or, the flap or apron may be provided on new jerseys so that the uniforms are initially provided with the slide apron already sewn or secured thereto.

It is the object of the present invention to provide an accessory garment for use with athletic uniforms and particularly baseball uniforms which includes a flap or an apron which extends across and covers the area between a player's jersey and pants so as to effectively prevent dirt and other debris from entering into the pants when the player executes a head first slide towards a base or when a player dives head first for a ball during the execution of a play.

It is another object of the present invention to provide an accessory for athletic uniforms which may be easily adapted to existing uniforms or provided with new uniforms and which provides for the effective elimination of the problem of dirt and debris entering or becoming trapped within a player's pants as a result of routine play.

It is also an object of the present invention to provide an accessory for baseball uniforms which includes a protective flap which prevents dirt and debris from entering and becoming trapped in the players pants and which is designed to be complimentary to the existing uniform so that the overall appearance of the uniform is not adversely affected.

It is another object of the present invention to provide an accessory in the form of a protective flap for use with baseball uniforms which may be selectively secured to a uniform so that during play, dirt and debris is prevented from entering between the jersey and pants and which may be removably secured so that the flap may be replaced or removed for cleaning as is desired.

DESCRIPTION OF THE PREFERRED EMBODIMENT

Figure 1:
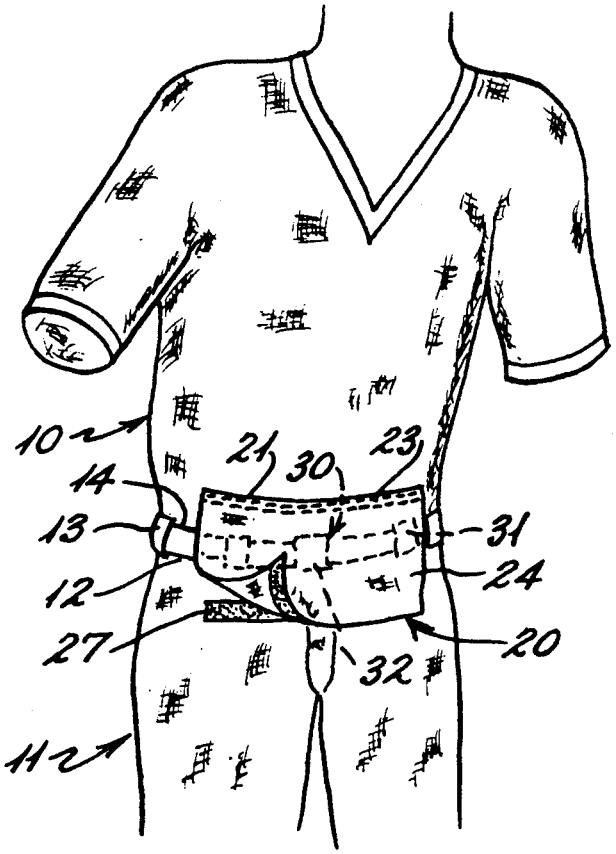
FIG. 1 is a partial illustrational view showing a baseball uniform including pants and jersey and to which the flap of the present invention is secured showing one edge of the flap being lifted from its engagement with the pants.

With continued reference to the drawings, a baseball uniform is shown which includes a jersey or shirt 10 and a pair of pants or trousers 11. In the embodiment shown in FIGS. 1 and 3, the pants include a waist portion 12 having a series of belt loops 13 secured thereto through which a belt 14 may be selectively extended. In the embodiment shown in FIG. 4, the pants 11' include an upper waistband 15 which is constructed so as to be stretchable. The outer surface of the waistband 15 may include a colored or patterned configuration or design which encircles the pants and which may include the team colors.

Figure 2:
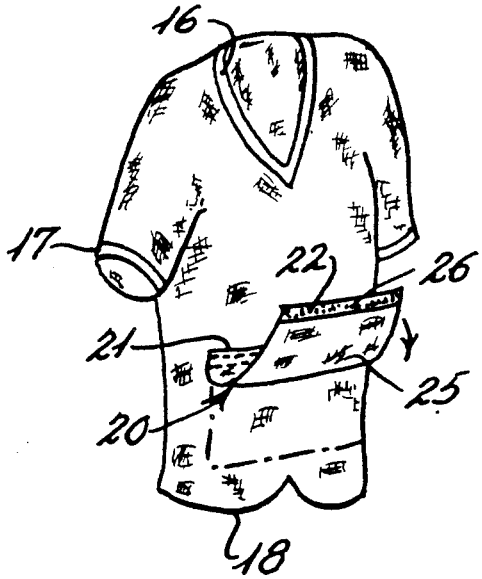
FIG. 2 is an illustrational view of the shirt of a baseball uniform to which the flap or apron of the present invention has been secured showing the lower free edge with the under surface being provided with a suitable fastening strip.

The jersey or shirt 10 includes an open neck portion 16, arms 17 and a lower or tail portion 18. A material or fabric flap or apron 20 is provided which has upper and lower edges 21 and 22, respectively. The entire length of the upper edge 21 is secured by stitching 23 to the jersey so that the upper edge is in spaced relationship with respect to the lower portion of the jersey. As shown, the flap extends substantially outwardly so as to extend the substantially across the entire width of the jersey. The length of the flap taken between the upper and lower edges is generally less than the length of the jersey from the point at which the upper edge thereof is secured to the jersey to the lower portion 18 thereof, as is shown in dotted line in FIG. 2. The flap is only secured along the upper edge 21 to the jersey so that the remaining portion thereof is freely moveable with respect to the front of the jersey.

Figure 3:
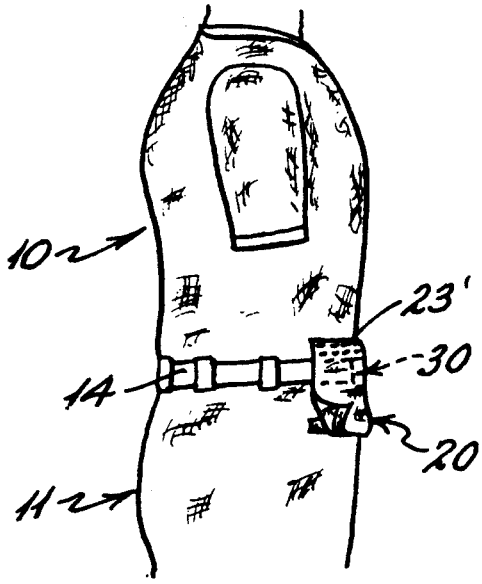
FIG. 3 is a right side view of the illustration of FIG. 1 showing a modified embodiment of the invention.

Although, in the preferred embodiment, the flap or apron 20 is stitched to the front of the jersey so that the upper edge is continuously secured to the jersey, it is envisioned that the upper edge could be fastened by other fasteners such as by zippers as is shown in FIG. 3. The entire upper edge should be continously fastened to prevent any material from passing between the upper edge of the flap and the jersey.

The apron 20 is designed to extend over the upper or waist line portion of the pants when the uniform is being worn. In this respect, after the jersey is tucked into the pants so that the tail or lower portion thereof is inside the pants, the lower portion of the flap may be extended over the waist portion of the pants as is shown in FIGS. 1, 3 and 4.

The flap or apron 20 includes an outer surface 24 and an inner surface 25. In the preferred embodiment shown in FIGS. 1, 2 and 4, the lower inner edge of the flap is provided with a suitable fastening element 26 which extends across the length of the flap and which may include an interengaging hooked fabric material such as VELCRO TM. In order to secure the lower edge 22 of the flap to the pants after the flap has been extended across the waistline, the pants may be provided with a complimentary fastener such as a hooked fabric interengaging material 27 such as VELCRO TM which is provided in spaced relationship just below the waistband or belt line of the pants, as is shown in FIGS. 1 and 4. Once the shirt or jersey has been tucked into the pants, the fastening material 26 of the flap may be engaged with the complimentary fastening material 27 so as to secure the flap across the waistline so that the flap is connected both to the jersey and to the pants. In this manner, the conventional opening between the shirt and pants is effectively covered thereby preventing dirt or debris from entering into the pants as the player slides across the ground as when attempting to slide into a base or diving to make a catch when fielding.

In the embodiment shown in FIG. 1, as the panel 20 covers the belt along the front portion of the uniform, and in order to complete the appearance of the uniform, a number of belt loops 31 may be provided along the outer surface 24 of the flap or apron and a simulated belt 32 may be provided across the outer surface of the flap and beneath the loops so as to give the appearance that the belt extends completely around the uniform and exterior of the flap 20. A simulated belt buckle 32 may also be provided. The simulated belt and buckle may be formed of a fabric material which is sewn or otherwise secured across the front 24 of the panel 20.

Figure 4:
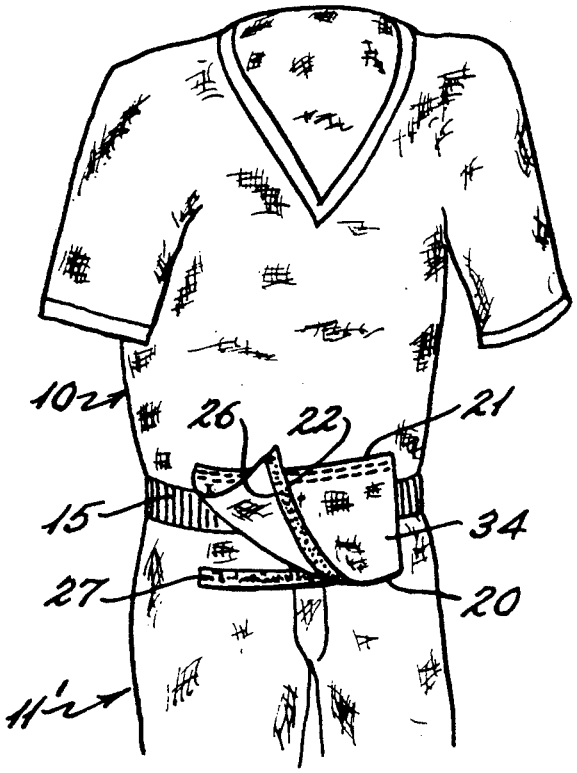
FIG. 4 is an illustrational view of another embodiment of the present invention wherein the front portion of the flap includes colored material which is designed to match the striping and configuration of a waistband of the pants to which the flap may be selectively secured.

In the embodiment shown in FIG. 4, there is no belt provided on the uniform so the front of the flap may be modified by providing a decorative strip or simulated waistband 34 which extends across the full width thereof which strip is simulative of the design of the waistband 15. In this manner, the uniform will appear to be complete when the apron is in use.

It should be noted that although the use of interlocking fabric fasteners such as VELCRO TM has been discussed for securing the bottom of the flap to the pants, the fastening elements 26 and 27 could be formed of other types of fasteners including snaps, zippers and the like.

With regard to FIG. 3 of the drawings, an embodiment of the invention is shown wherein the lower portion 22 of the flap or apron 20 is not secured to the trousers or pants 11 but is allowed to simply hang from the jersey over the belt line. In this embodiment, simulated belts or waistbands may also be provided as is necessary.

The fabric panel or flap 20 is designed to be easily secured to conventional or new jerseys or shirts. Once the flap has been secured to the jersey or shirt as discussed above, and after the shirt has been tucked into the pants, the flap is free to be extended over the belt or waistband so that the flap essentially closes the area between the pants and the jersey so that no dirt or other debris can enter into the pants as a player slides on their stomach or side. In those embodiments where the fabric panel is removably connected to both the jersey and the pants, the panel may be easily replaced in the event that it is torn during an act of sliding or can be easily removed for cleaning as is necessary. The material from which the panel is made should generally be compatible with or identical to the fabric from which the uniform jersey is made.

I claim:

1. In an athletic uniform having a combination jersey and pants wherein the jersey includes a lower tail portion and the pants include a waist portion and wherein the jersey and pants include front portions and spaced side portions, the improvement comprising a fabric flap, said fabric flap having upper and lower edges and a pair of spaced side edges, securing means for continuously sealing substantially the entire upper edge of said fabric flap to the jersey so that said upper edge of said flap is secured in spaced relationship with respect to said lower tail portion of the jersey, said lower edge of said fabric flap being moveable with respect to the front portion of the jersey when said upper edge is secured thereto, said fabric flap being of a length when measured between said upper and lower edges thereof so as to extend over the waist portion of the pants when the uniform is being worn with the lower tail portion of the jersey tucked into the pants, and said fabric flap extending substantially between the side portions of the jersey whereby said fabric flap extends over the waist portion of the pants when the uniform is being worn to thereby prevent material from passing between the jersey and pants.

2. In the athletic uniform of claim 1, said fabric flap having inner and outer surfaces, first fastening means disposed along said lower edge of said fabric flap and along said inner surface thereof, second fastening means mounted on the front portion of the pants in spaced relationship with respect to said waist portion thereof, said first fastening means of said fabric flap being selectively connected to said second fastening means mounted on the pants.

3. The athletic uniform of claim 2 in which the pants include belt loops exposed around said waist portion thereof, a belt extending through said loops, and a simulated belt means disposed across said outer surface of said fabric flap so as to be in alignment with said belt when the uniform is being worn.

4. The athletic uniform of claim 2 in which the waist portion of the pants includes a waistband having a design, said fabric flap means having a simulated waistband formed thereon and extending between said portions thereof and having an appearance similar to said design, said simulated waistband being oriented intermediate said upper and lower edges of said fabric flap.

5. The athletic uniform of claim 2 in which said first and second fastening elements are interengaging fabric fasteners.

6. The athletic uniform of claim 2 in which said upper edge of said fabric flap is fixedly secured to the jersey.

7. The athletic uniform of claim 2 in which said securing means is releasable to permit said upper edge of said fabric flap to be detachable from the jersey.

8. The athletic uniform of claim 4 in which said securing means is releasable to permit said upper edge of said fabric flap to be detachable from the jersey.

9. The athletic uniform of claim 1 in which said securing means is releasable to permit said upper edge of said fabric flap to the jersey.

10. A protective garment for use with an athletic uniform which includes a jersey and pants wherein the jersey includes a lower tail portion and the pants include a waistband and wherein the jersey and pants include front portions and side portions, the protective garment comprising a fabric flap, said fabric flap having a upper and lower edges and spaced side edges, securing means for continuously sealing the entire upper edge of said fabric flap to the jersey so that said upper edge is in spaced relationship with respect to the lower tail portion of the jersey, said lower edge of said fabric flap being moveable with respect to he front portion o the jersey when said upper edge is secured thereto, said fabric flap being of a length when measured between said upper and lower edges thereof so as to extend over the waist portion of the pants when the uniform is being worn with the lower tail portion of the jersey tucked into the pants, and said fabric flap being of a length between said side edges to extend substantially between the side portions of the jersey and pants whereby when said fabric flap is secured to the jersey it will extend over the waistband of the pants when the uniform is being worn to thereby prevent material from passing between the front portions of the jersey and the pants.

11. The protective garment of claim 10 in which said fabric flap has inner and outer surfaces, and fastening means disposed adjacent said lower edge of said fabric flap and along said inner surface thereof for selectively engaging the front portion of the pants.

* * * * *